US011786012B1

(12) United States Patent
Houston, III

(10) Patent No.: US 11,786,012 B1
(45) **Date of Patent: *Oct. 17, 2023**

(54) INSERT FOR FOOTWEAR

(76) Inventor: Telfair W. Houston, III, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/653,627

(22) Filed: Dec. 16, 2009

Related U.S. Application Data

(63) Continuation of application No. 11/452,514, filed on Jun. 14, 2006, now abandoned.

(60) Provisional application No. 60/690,660, filed on Jun. 15, 2005.

(51) Int. Cl.

| | |
|---|---|
| ***A43B 23/08*** | (2006.01) |
| ***A43B 7/32*** | (2006.01) |
| ***A43B 23/02*** | (2006.01) |
| ***A43B 19/00*** | (2006.01) |
| ***A43B 7/1405*** | (2022.01) |
| *A43B 7/08* | (2022.01) |

(52) U.S. Cl.
CPC ..... *A43B 23/0265* (2013.01); *A43B 7/1405* (2013.01); *A43B 7/08* (2013.01)

(58) Field of Classification Search
CPC ..... A43B 7/078; A43B 7/1405
USPC ..... 36/77 R, 72 R, 77 M, 88, 93, 94, 102, 71
See application file for complete search history.

(56) References Cited

U.S. PATENT DOCUMENTS

| | | | | | |
|---|---|---|---|---|---|
| 1,436,463 | A | * | 11/1922 | Silver | 36/10 |
| 3,243,901 | A | * | 4/1966 | Clarizio | A43B 17/16 D24/189 |
| 3,561,142 | A | * | 2/1971 | Streit, Sr. et al. | 36/72 R |
| 3,995,382 | A | * | 12/1976 | Smith | 36/72 R |
| 4,648,923 | A | | 3/1987 | Chapnick | |
| 4,769,926 | A | | 9/1988 | Meyers | |
| 4,782,605 | A | | 11/1988 | Chapnick | |
| 4,887,369 | A | | 12/1989 | Bailey et al. | |
| 4,967,493 | A | * | 11/1990 | Mues | A43C 13/14 36/126 |

(Continued)

FOREIGN PATENT DOCUMENTS

| | | |
|---|---|---|
| WO | 2004037029 | 5/2004 |

*Primary Examiner* — Jila M Mohandesi
(74) *Attorney, Agent, or Firm* — Christopher Mayle; Bold IP, PLLC

(57) ABSTRACT

Disclosed is a readily removable molded insert for footwear, including dress or casual shoes and sneakers. The insert may be manufactured from a variety of resiliently compressible, semi-rigid, and/or resiliently deformable materials and is designed for the purpose of maintaining the general shape and appearance of the upper section of a shoe. Embodiments of the insert are specifically designed to adapt to and conform to the shape of footwear and also to adapt to the contour of a user's foot while the footwear is being worn. The insert may be further cut, trimmed, or separated to fit a range of shoe sizes, by use of perforations along the outer rim of certain embodiments of the insert. Another embodiment of the insert may remain adhesively attached to the inside of the shoe, or it may be removed and repositioned within the shoe, as necessary.

18 Claims, 5 Drawing Sheets

(56) References Cited

U.S. PATENT DOCUMENTS

| | | | | |
|---|---|---|---|---|
| 5,740,618 | A * | 4/1998 | Minden | A43B 5/12 36/71 |
| 5,947,918 | A | 9/1999 | Jones et al. | |
| 6,397,848 | B1 | 6/2002 | Kagekata et al. | |
| 6,584,978 | B1 | 7/2003 | Brett et al. | |
| 6,631,568 | B2* | 10/2003 | Howlett et al. | 36/43 |
| 7,028,417 | B2* | 4/2006 | Tingle | A43B 3/101 36/26 |
| 2002/0104174 | A1* | 8/2002 | Bartlett et al. | A43B 7/32 12/146 D |
| 2002/0184794 | A1* | 12/2002 | Peterson et al. | A43B 7/32 36/77 R |
| 2006/0070262 | A1* | 4/2006 | Shaw et al. | A43B 23/087 36/77 R |

* cited by examiner

TOP-SIDE

A - A

BOTTOM SIDE

CUT INSERT TO FIT
CORRECT SHOE SIZE.

INSERT FOR FOOTWEAR

CROSS REFERENCE TO RELATED APPLICATIONS

This application claims the benefit of U.S. Provisional Application #60/690,660, filed on Jun. 15, 2005, and is further filed as a continuation of U.S. Non-Provisional Application, serial number 11/452,514, filed on Jun. 14, 2006, the contents and description of which are hereby incorporated herein by reference.

FEDERALLY-SPONSORED RESEARCH & DEVELOPMENT

There is no federally sponsored research or development in connection with this inventive concept.

NAMES OF THE PARTIES TO A JOINT RESEARCH STATEMENT

There is no joint research agreement applicable to this inventive concept.

BACKGROUND OF THE INVENTION

Field of the Invention

The present invention is directed to methods and materials for a form-saving insert designed as a solution to the problem of improved maintenance and appearance of footwear in the categories of sneakers, dress and casual shoes, and dress and casual boots after several wearings. The methods and materials of the present invention are especially useful for the preservation, improved appearance, and durability of casual and dress footwear.

Sneakers and casual footwear have become a major part of the shoe and footwear industry, becoming fashionable beyond the use originally contemplated or for which they were created (e.g., basketball shoes, tennis shoes, boating shoes, running shoes). Many youth and young adults wear sneakers as everyday footwear, as fashion accessories and as status symbols. Over time and use, creases and knotting frequently form in the toe and vamp area of sneakers and footwear, making them appear less attractive to the consumer and on-lookers, and decreasing the useful life of the footwear. Thus, the wearer of such footwear faces the problem of constant maintenance or the costly replacement of sneakers, shoes, and boots that become worn out in appearance, although they are relatively new.

One traditional approach to reduce this problem was to stuff the fronts of footwear with tissue paper or extra socks to avoid the creases and help sneakers look newer longer. It has also been widely known to maintain the shape and appearance of casual and/or dress footwear using "shoe trees." Shoe trees are inserted into the shoe when it is not being worn, and typically comprise two parts, a front and rear, connected by a spring mechanism, to force the front and rear apart. Shoe trees are typically made from rigid materials, such as cedar or plastic.

However, shoe trees are relatively expensive, cumbersome, and heavy. When not in use, they take up closet or storage space. In addition, over time, the shoe tree's spring mechanism will wear out, limiting its useful life. Other shoe inserts are known, but are typically designed to improve the orthopedic fit, comfort or support, or to absorb moisture or odors. None of the available inserts provides the ease of use, affordability, versatility and flexibility of the present invention for maintenance of the shape and appearance of footwear.

Accordingly, the present inventive concept provides a durable, inexpensive, easy to use and effective solution to the problem of permanently deformed footwear in the toe, front and side areas. Use of the present invention can extend the useable lifespan and maintain the appearance of the described footwear.

Description of the Prior Art

The following described prior art patents are believed to be pertinent to the type of invention which is presented herein.

U.S. Pat. #4,167,824 describes an inner sole insert which comprises (1) an open cell foam base capable of conforming to and substantially retaining the shape of compressive forces applied thereto, (2) an elastic closed cell foam layer having a maximum compression set of less than 50 percent and a two-way linear elongation which allows one face of said closed cell foam layer to shift laterally ⅛ to ½ inch with respect to the other face when a lateral force is applied to said one face, and (3) a stretch fabric bonded to one face of said closed cell foam layer with a rubbery adhesive.

WO04037029A1 discloses an article of footwear of interchangeable nature allowing different use, appearance and configuration; comprising an outer sole of unitary construction having a united toe, central and heel portion. Various types of footwear elements can be inserted into the outer sole, allowing conversion of the footwear into a sports', formal, sandal, water, slipper, dress, ornamented shoe or other footwear.

The inventor in U.S. Pats. #4,586,273, #4,648,923, and #4,782,605 described shoe inserts comprising a base layer of a relatively resilient material, a foam layer disposed over the base layer, a fabric disposed over the foam layer, means integrally forming the base layer, foam layer and fabric into a sheet tri-laminate, a support layer disposed only at the heel area of the insert and of a rigid material of higher density than that of the tri-laminate. U.S. Pat. 4,887,369 describes a convertible shoe with a removable top.

BRIEF SUMMARY OF THE INVENTIVE CONCEPT

In its simplest form, the disclosed device comprises a readily removable insert for maintaining the shape and condition of casual and dress footwear, said insert comprising three continuous sections:

(a) a convex front end having a perimeter elliptically shaped to conform to the frontal area of a shoe;
(b) a convex middle area which extends from the frontal area rearward toward the open end of the shoe; and
(c) a tongue end of the insert, wherein said tongue end is accessible and can be grasped for inserting and removing the insert from the shoe.

The present inventive concept provides several advantages, including ease of use, comfort, durability, and inexpensive production. The vertical thickness of the insert is sufficiently thin such that the insert may remain in the footwear while being worn, and cause no discomfort to the wearer. Thus, the inserts of the present invention can be used to preserve the shape and condition of footwear not only during storage, but also during use, and can improve the fit and comfort of the shoe. The insert may be made from a material which is moldable, formable, resiliently deformable, or resiliently compressible.

In preferred embodiments, the entire insert comprises a single or unitary piece. In other embodiments, the insert may comprise two or more pieces which have been suitably attached. In still other embodiments, the convex middle area of the insert is thicker than either the convex front end or the tongue end.

The devices disclosed herein may optionally comprise other features, including a plurality of pores extending vertically through the middle area of the insert, thus providing breathability for the wearer's foot. In other embodiments, the tongue end of the insert may comprise an elongated tab to facilitate ease of insertion and removal of the insert.

BRIEF DESCRIPTION OF THE VIEWS OF THE DRAWINGS

FIG. 1A provides a view of the upper surface of an insert, also showing multiple pores through the middle area of the insert. FIG. A-A presents a side cross-sectional view of FIG. 1A, as seen from the perspective of line A-A.

FIG. 1B presents a view of the inside surface of an insert of FIG. 1A.

FIG. 1C displays a left-side view of the insert, while FIG. 1D presents a view of the insert as seen from the open end of a shoe.

DETAILED DESCRIPTION OF THE INVENTION

Definitions

Figure 1A:
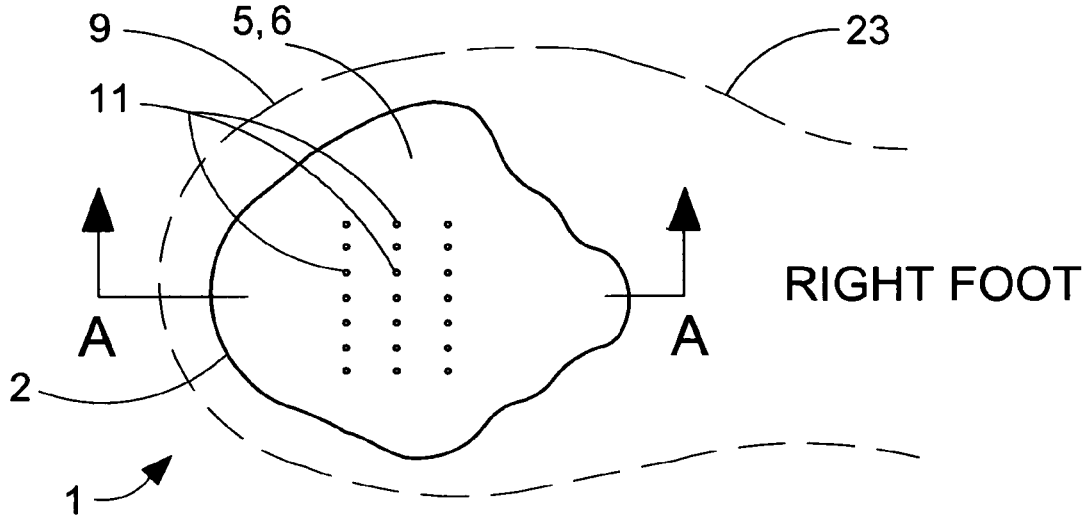
FIGS. 1A through 1D present five views of a preferred embodiment of the insert.

Unless otherwise defined herein, words and phrases used in this patent application shall be interpreted according to their usual meaning, or their meaning to one skilled in the art of footwear design and maintenance.

As used herein, the term "footwear," encompasses "shoe" (dress or casual) "boot" (dress or casual), and "sneaker," and these terms are often used interchangeably herein. One skilled in the art will appreciate that a sneaker or athletic shoe may typically be manufactured of different materials, and may be subject to more rigorous conditions of use than other types of footwear, and that a dress or casual boot typically extends longer than other types of footwear up to the ankle or even to the knee. The insert disclosed is particularly not suited nor designed for safety enhancement and/or protection with respect to work or industrial boots.

The term "frontal area" refers to that region of a shoe or insert which may comprise a narrow or tapered surface area at the front, accommodating the toes, and gradually widens to encompass the full width of the foot pad. The frontal area will typically encompass what is also known as the "vamp" of the shoe or footwear. The "front end" of a shoe is that portion which is defined by the shape or contour of the toe box of the shoe. The term "middle area" refers to that region of footwear, or of the insert, immediately behind the frontal area and just before the "open end" or "tongue end" of a shoe.

The term "tongue end" refers to that region of a shoe or insert distal from the toe or frontal area, or the "open end" of a shoe, and hence is located across the top of the foot from the frontal area of the insert toward the heel, to approximately the point where the foot and ankle are joined. It should be understood that the disclosed inserts may be used with footwear which do not technically include a separate tongue, such as a loafer or boot, and the location of the tongue end remains essentially unchanged in such instances. The tongue end of the insert is such that it is accessible when the footwear is not being worn. In other words, when the insert is placed within the footwear, the 'tongue end' is positioned closest to the open end of the shoe through which the foot would normally be placed.

The term "thickness" of an insert refers to the vertical dimension running from the upper or outer surface of the insert, which would be in contact with the shoe, to the lower or inside surface of the insert, which is adjacent to the wearer's foot, sock or hosiery when the shoe is worn. The terms "upper" and "outside," and "outer," when referring to an insert, or any section of an insert, may be used interchangeably. Likewise, the terms "lower," "inside," and "inner," when referring to the surface of an insert, or any section of an insert, may be used interchangeably.

For the present inventive concept, the term "convex" refers to a contour which generally conforms to the shape of the inner surface of a shoe, from side-to-side. "Convex" inserts will generally have an upper or outer surface which may be slightly arced or arched from the front toward the back of the footwear, such that the insert resists deformation. The convex outer surface of the insert will generally complement the inner surface of the footwear with which it will come into contact. The lower or inside surface of the insert may be considered to be "concave," because it has a shape which is generally complementary to the wearer's instep and/or upper surface of the foot.

For the inserts disclosed herein, the term "rounded," when referring to the "front end" of an insert, describes a shape which will generally conform to the frontal area or front end of a sneaker or other casual footwear. The "front end" of a sneaker or other casual footwear is usually both rounded and convex; consequently, the front end of the insert may be rounded, as well as convex. However, it should be understood that the front end of the insert need not be rounded in all its embodiments, particularly for embodiments that are intended for specialized footwear having a toe box which is pointed, squared, or of other uncommon shape.

The terms "moldable," "formable," "deformable," and "compressible" each refers to a material's ability to assume a particular shape or form. "Moldable" refers to a material which will permanently assume a desired shape, while "compressible" refers to a material which will assume a desired shape when pressure is applied. A "resiliently compressible" material will revert to its original shape when the pressure is abated. The term "deformable" refers to the alteration of a material to a shape which is not desirable for the fit or appearance of the material. A "resiliently deformable" material will revert to its original shape after the deforming pressure or factor is abated. However, a "permanently deformed" material will no longer be able to revert back to the original desired appearance or shape. The process of "resiliently deforming" or "resiliently compressing" may be repeated many times without the material losing its elasticity.

As further explained herein, the term "sizing means" refers to methods for altering the size of the inserts of the present inventive concept, such that the inserts are capable of fitting shoes or footwear of varying sizes or types.

Numerical Index to Component References

| | | | |
|---|---|---|---|
| **1**. | Insert | **16**. | Left foot insert |
| **2**. | Convex front end | **17**. | Right foot insert |
| **3**. | Upper (outer) surface of front end | **18**. | Velcro-type felt strip |
| **4**. | Lower (inner) surface of front end | **19**. | Velcro-type hook strip |
| **5**. | Convex middle area | **20**. | Inner surface of footwear |
| **6**. | Upper (outer) surface of middle area | **21**. | Outer surface of footwear |
| **7**. | Lower (inside) surface of middle area | **22**. | Open end of shoe |
| **8**. | Tongue | **23**. | Outline of shoe |
| **9**. | Frontal area of shoe | **24**. | Casual or dress shoe |
| **10**. | Thickness of insert | **25**. | Outer rim |
| **11**. | Pores | **26**. | Concave shape |
| **12**. | Front end of insert | **27**. | Sneaker |
| **13**. | Insert's tongue end | **28**. | Durable adhesive strip |
| **14**. | Mid-indentation | **29**. | Elongated tab |
| **15**. | Short indentation | | |

Functions of the Inventive Concept

The devices disclosed herein are generally presented in FIG. 1A through FIG. 1D, and are particularly described, using the term "footwear" and "shoe" interchangeably. The insert 1 is shaped and countered of materials which are effective in maintaining the shape and condition of footwear, comprising devices which may be removably or permanently placed into the footwear. The insert 1 basically comprises:

(a) a convex (side-to-side) front end 2 contoured to conform to the interior frontal area of a shoe 23;

(b) a convex (side-to-side) middle area 5 which extends from the frontal area rearward toward the tongue of the shoe; said middle area 5 having a width and shape which conforms to the inside surface of the shoe; and optionally (c) a tongue end 13 of the insert, wherein said tongue end 13 is accessible and can be used for inserting and removing the insert 1 from a shoe. In some embodiments the tongue end 13 may comprise an extended length dimension so as to function as an elongated tab 29.

Figure 2A:
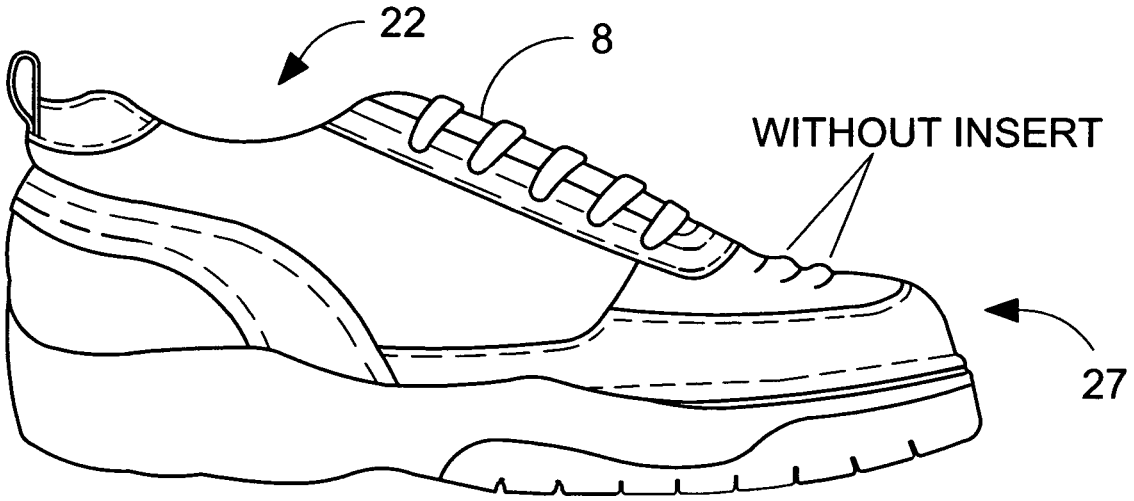
FIGS. 2A and 2B provide two representations of a shoe, displaying differences between use and non-use of an insert.
Figure 2B:
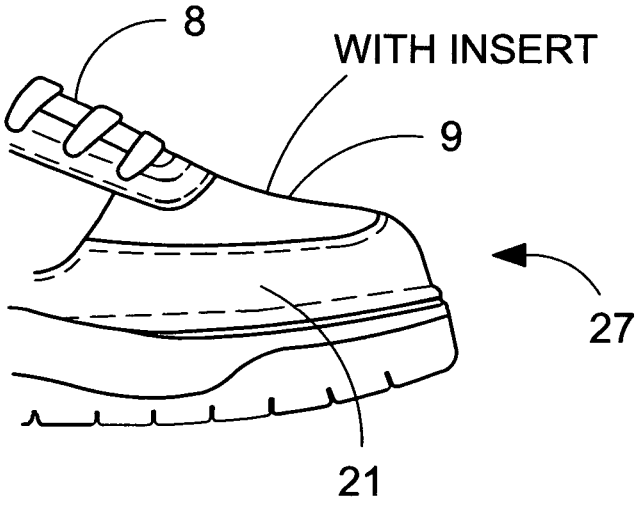

In some embodiments, the thickness of the insert 1 may be such as to allow the insert 1 to remain within the shoe while it is being worn. FIG. 2A and FIG. 2B depict the improvement in the appearance of the front end 9 of a sneaker 27 by use of an insert 1 (not in view) as opposed to non-use of an insert 1.

For production of the insert 1, preferred materials should generally have characteristics ranging from semi-rigid to pliable. Any material which can be molded into a convex form, and will retain its shape over time, may be used, and it is preferred that the material be compressible, resiliently compressible, or resiliently deformable during insertion and removal of the insert 1. However, the material comprising the insert will return to its original shape once it is placed into position in the shoe, or removed. In preferred embodiments, the material should be such that the insert 1 may be slidably inserted and removed from the shoe without undue exertion. Many such materials are commercially available and include plastics, hard rubber, gels, resins, elastomers and composites of the foregoing.

In other embodiments, the insert 1 material may comprise thermoplastic material which is rigid at room temperature. For example, upon heating in nearly boiling water, the thermoplastic material may become moldable, such that the insert can be molded to achieve a customized fit for a wearer's foot in a particular shoe. Suitable examples of thermoplastic materials may include materials made for use in making molded mouth guards. The insert 1 material may comprise qualities allowing it to withstand moisture and odors without becoming permanently deformed and/or picking up the odor. The insert 1 may optionally be treated or coated with an antifungal, antibacterial or aromatic substance in preferred embodiments, so as to resist or dispel odors, bacteria and other microbes. Other potential materials may include Gore-Tex®, rubber, vulcanized rubber, FEP Teflon, nylon, PEBAX, silicone, polyurethane, polytetrafluoroethylene (PTFE), ethylene vinyl acetate (EVA), styrene, or polystyrene. For examples of other useful thermoplastic materials, the reader is referred to U.S. Pat. #6,584,978, U.S. Pat. #6,397,848 and U.S. Pat. #5,947,918. For an example of a breathable laminate that might be useful for this inventive concept, see U.S. Pat. #4,344,999. The disclosure of each of these documents is hereby incorporated herein for the disclosure cited.

As described above, the insert 1 may comprise a single unitary piece, or may comprise two or more pieces which have been suitably attached so as to provide an insert 1 with the properties described herein. In the case of a unitary piece, the insert 1 may be made using a single mold. Where two or more pieces are used, each may be molded separately and then fused, or suitably attached through other means.

The insert 1 should be of dimensions that are suitable for insertion and removal from most commonly available shoe sizes. In preferred embodiments, the insert 1 is of sufficiently small thickness 10 that it may remain in the shoe while the shoe is being worn. The insert 1 should fit snugly inside the shoe, but the user should be able to remove the insert 1 from the shoe with little effort, simply by pulling on the tongue end 13. The wearer should be able to slidably insert his or her foot into the shoe comfortably, while the insert 1 is in the shoe, yet the insert 1 should not come out inadvertently.

Figure 1B:
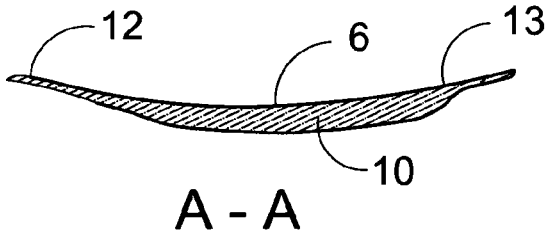
Figure 1B:
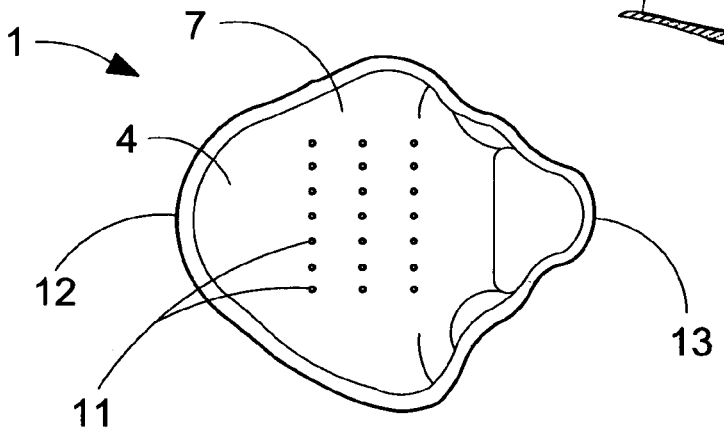
Figure 1C:
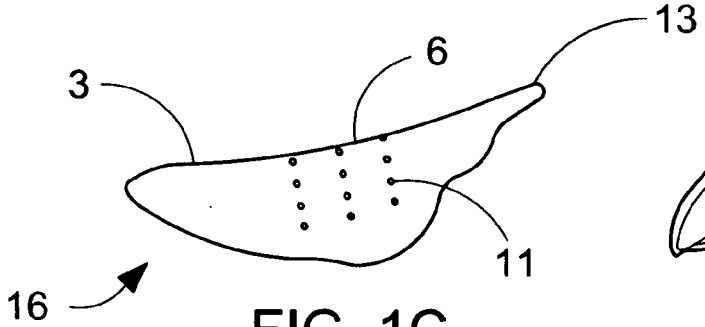
Figure 1D:
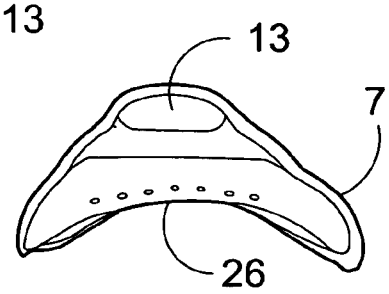

The following suggested non-limiting ranges are provided as typical dimensions for snugness and ease of use of the insert 1, as depicted in FIGS. 1A through 1C, and FIG. AA:

preferred width across the middle area 6, approximately 60 to 120 mm; preferably 80 to 100 mm;

preferred length from frontal end 12 to tongue end 13, approximately 80 to 160 mm; preferably 100 to 140 mm;

preferred width of tongue end 13, approximately 10 mm to 30 mm;

preferred thickness of insert 16 at frontal end 12, approximately 2 to 10 mm;

preferred thickness of insert 16 at middle area 6, approximately 2 to 20 mm;

preferred thickness of insert 16 at tongue end 13, approximately 2 to 20 mm.

For children's footwear, the above cited insert 1 dimensions should be suitably reduced. A selection of smallersized inserts 1 may provide an additional advantage for children whose feet are still growing. An insert 1 may be used which will provide comfort of fit in a slightly larger shoe size. As the child's feet grow larger, the inserts 1 may be removed, thereby allowing proper fit of the larger foot into the shoe. As will be readily appreciated, the insert shape may be contoured so as to fit either foot, or to specifically accommodate either the left or right foot. Alternatively, a single shape or form may be suitable for use with either foot or shoe in its original condition, or may be moldable, compressible, resiliently compressible or resiliently deformable so as to specifically accommodate either foot in certain types of shoes.

In certain embodiments, the width of the middle area 6 of the insert 1 is sufficient to cover the top of the foot. In other embodiments, the middle area 6 may have sufficient width so that it will extend beyond the top of the foot; in these embodiments, the sides of the middle area 6 may be moldable, compressible, resiliently compressible or resiliently deformable such that the middle area 6 conforms to the shape of the footwear.

Figures 4A, 4B, 4C:
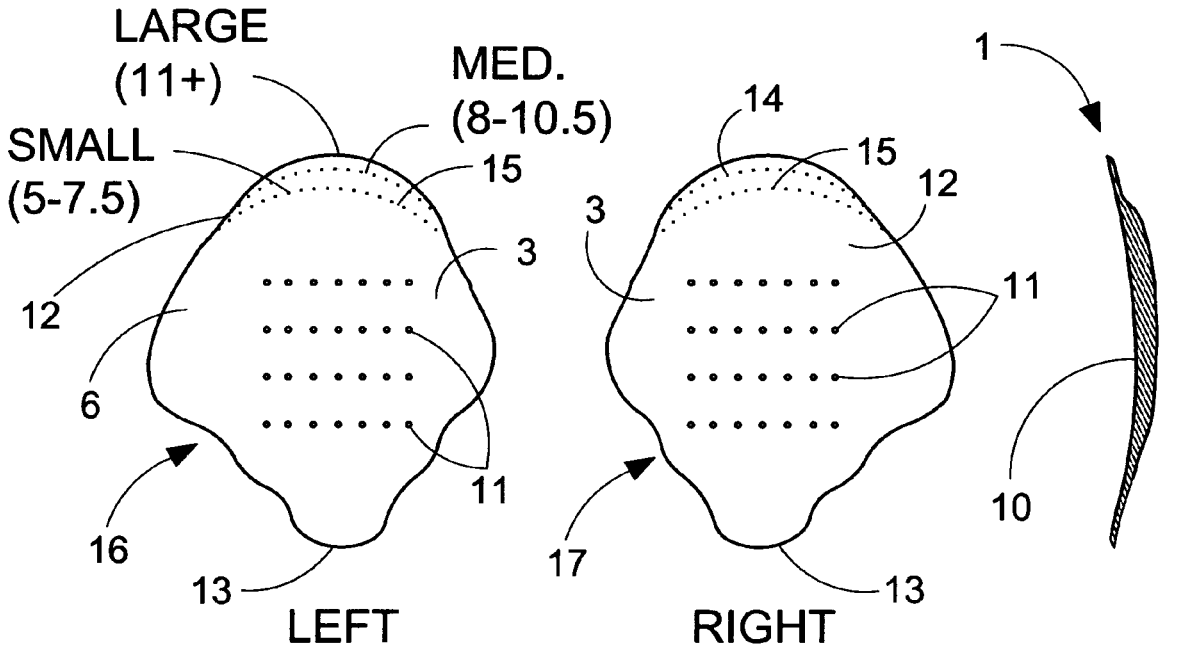
FIGS. 4A and 4B provide top views of a preferred embodiment, displaying inserts for the left foot and right foot, respectively, and further displaying indented/perforated outer rims.
FIG. 4C provides a cross-sectional view of the inventive concept.

In other embodiments, the inserts 1 comprise sizing means which allows for optimal fit within a range of shoe sizes. As shown in FIGS. 4A and 4B, the sizing means may comprise a plurality of outer rims 25 having perforations or indentations placed around the front end 12 of each insert 16, 17. The outer rims 25 are located and manufactured by a process enabling the cutting, tearing off, or otherwise removing one or both of the outer rims 25. Once the outer rim(s) 25 is removed, the insert 1 is suitable for use with a different size or different type of shoe.

Because an individual's left and right foot are usually mirror-images of each other in shape, it may be appropriate to provide the inserts 1 in pairs, as shown in FIGS. 4A and 4B. Each pair would comprise two shapes conversely reflective of each other. Alternatively, the inserts 1 may comprise two shapes of identical contour, each of which is amenable to being molded or compressed into shapes suited for the left foot and right foot, respectively.

The preferred method of construction provides optimal dimensioning of the insert 1 thickness 10 such that the insert 1 may remain in the shoe while it is being worn. The inserts can be used to maintain shape and condition of footwear during storage, while being worn, or in either situation. In particular embodiments, each insert may comprise a plurality of pores through its thickness 10, as shown in FIG. 4A and FIG. 4B, thus providing for breathability. In another embodiment, the lower or inside surface 4, 7, of an insert 1, which will comes into contact with the wearer's foot, sock, or hosiery, may comprise an additional thickness layer. The additional layer may be padded for comfort and/or may provide odor and moisture resistance. This layer may be permanently or removably affixed to the inside surface 4, 7, of the insert 1 by using means such as a durable adhesive or Velcro®, or other similar hook-and-loop type fastener.

Figure 3:
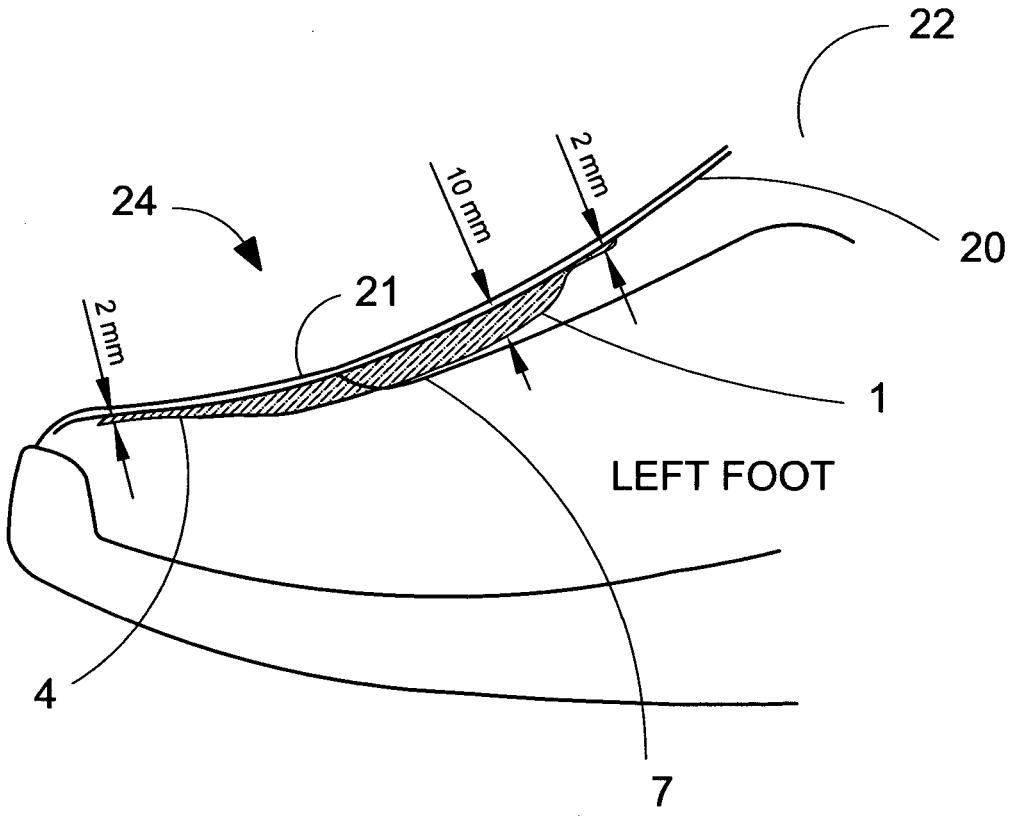
FIG. 3 illustrates a cutaway side view of a casual style shoe with an insert in place, said insert showing a range of thicknesses at each of the three sections of the insert.
Figures 5A, 5B:
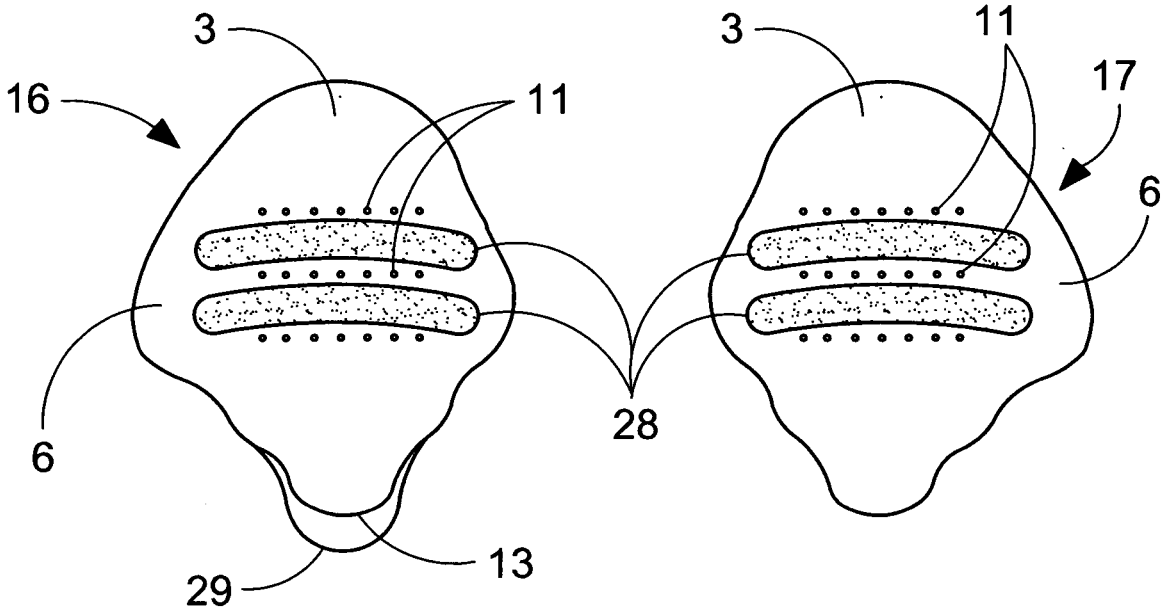
FIGS. 5A and 5B provide views of the upper surface of a left insert and a right insert, further having durable adhesive strips attached to the upper surface of each insert, and elongated tabs.
Figure 5C:
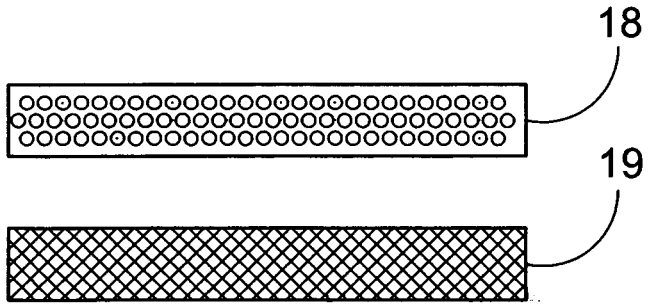
FIG. 5C illustrates Velcro-type fastening strips which may be positioned transversely across the upper surface of an insert.

The upper, or outer surface 3, 6, of the insert 1, which will come into contact with the footwear when the insert 1 is inside of the footwear, should preferably be of a sufficient roughness to provide sufficient friction that will maintain the insert 1 in the footwear when the wearer's foot is removed. Thus, the insert 1 will not come out of the footwear when the foot is removed, but only when the user wishes to remove the insert 1. If desired, the outer surface 3, 6, of the insert 1 may be permanently affixed to, or the insert 1 may be contained in, the inner surface 20 (see FIG. 3) of the footwear, such that the insert 1 may preferably be provided together with the footwear, or may be removably affixable, for example, using adhesive means such as a durable adhesive or Velcro-type fastener. A more advanced embodiment is shown in FIGS. 5A and 5B, wherein one or more Velcro-type fastening strips are positioned across the outer surface 3, 6, of the insert, so that it will adhere to the inner surface 20 of a shoe, thus preventing the insert 16, 17 from coming out inadvertently.

In a different embodiment, the inventive concept provides a pocket or opening into which the insert may be placed. Optionally, the pocket or opening may comprise a permanent part of the inner surface 20 of the footwear, or may be removably affixed to same, using such means as a durable adhesive or Velcro®-type fastener. The pocket may comprise a flap to maintain the insert in the pocket. Once the insert 1 is placed inside the pocket or opening, the flap may be closed or sealed, using an appropriate means.

Yet another arrangement is to have the insert 1 sewn into the lining of the footwear, such that the insert 1 is always in place within, for instance, a shoe, rather than being removable. In such cases, the insert 1 will typically be sold as an integral part of the shoe.

In other embodiments, the tongue end 13 of the insert 1 may be elongated, or comprise an elongated tab 29 (FIGS. 5A and 5B), which will be useful for insertion and removal of the insert 1. This is particularly convenient for use with boots or other high-topped footwear. In order to facilitate placement of an insert 1 into the desired location within footwear, and also removal of the insert 1, the elongated tab 29 may comprise a more rigid material than the other segments of the insert.

Further, the tongue end 13 of an insert 1, or elongated tab 29 if present (as shown in FIG. 5A and FIG. 5B), may additionally comprise a snap, laces, buckle, hook-and-loop type mechanism, or other removable fastening means for attaching the tongue end 13 to the footwear. In such embodiments, the complementary removable fastening means [e.g., the 'female end' of a snap or buckle, or the receiving component of hook-and-loop fasteners] may be a component of the insert 1, which may be optionally affixed to the footwear. In another prospective design, the footwear may be manufactured with the complementary removable fastening means as an integral element of the footwear.

Other specialized embodiments are contemplated, such as a specially designed comfort insert 1 for women's footwear. Such an insert 1 differs for women's footwear because they preferably comprise adhesive shapes on a strip, designed for women's shoes which frequently comprise straps and may be open on top or at the toes. In addition, for women who wear shoes with no stocking or protection to their toes there is frequently an area of extreme discomfort along the straps, depending on the style, and shape of shoes. In such a case, the insert 1 will preferably be of a shape and size so as to conform to the shape and size of the straps, and will preferably adhere to the tops and rims of the shoes, providing a barrier between the footwear and the foot. In preferred embodiments of this concept, the inserts 1 would comprise an inside layer which will absorb moisture, sweat and odors. For these embodiments, the inserts 1 preferably comprise an adhesive surface, which may be protected during storage using a non-adhesive backing sheet applied to the adhesive surface. When ready for use, the inserts 1 may be separated from the backing sheet, exposing an adhesive surface for application to the shoe. These embodiments may also be useful for other open shoes, which can be worn by men, women or children, such as sandals and flip-flops.

While there have been disclosed several different embodiments of the present inventive concept, it will be appreciated that many modifications and improvements may be made therein without, however, departing from the essential and literal embodiments of the claimed invention, or equivalents thereof. Such modifications and improvements are still considered to be within the scope of the claims of this inventive concept. All publications, United States Patents and other sources referred to in this specification are incorporated herein by reference for the disclosure for which they are cited.

What is claimed is:

1. A removable insert for maintaining shape and condition for footwear, constructed from a semi-rigid, deformable material, comprising three contiguous sections, a front end, a middle area, and a tongue end, with each section having a convex upper surface from side-to-side, and a concave lower surface side-to-side, wherein the front end comprises a thickness in a range from 2 to 10 millimeters, wherein the convex upper surface of the middle area is generally conformable to a vamp of the footwear, and comprises a thickness in a range of 2 to 20 millimeters and a width in a range of 80 to 120 mm, wherein the tongue end comprises a thickness in a range of 2 to 20 millimeters, a width in a range of 10 to 30 millimeters, and extends rearwardly beyond said middle area for a length in a range of 10 to 30 millimeters, wherein an entirety of the removable insert comprises one continuous molded piece with a length in a range from 80 to 160 millimeters, and further, having a means for attaching the removable insert to an interior surface of an upper portion of the footwear.

2. The removable insert as in claim 1, wherein a layer of moisture absorbent material is attached to the concave surface of the middle area of said removable insert.

3. The removable insert as in claim 1, wherein said removable insert is treated with an anti-bacterial substance.

4. The removable insert as in claim 1, wherein a plurality of ventilating pores extends through the thickness of the middle area of said removable insert.

5. The removable insert as in claim 1, wherein at least one series of perforations is constructed around an outer rim perimeter of the front end of said removable insert.

6. The removable insert as in claim 1, wherein the tongue end comprises an elongated tab with thickness in a range of 2 to 20 millimeters, a width in a range of 20 to 40 millimeters, and extends rearwardly beyond said middle area for a distance in a range of 20 to 40 millimeters.

7. A removable insert for maintaining a shape and condition for footwear, constructed from a semi-rigid, deformable material, comprising three contiguous sections, a front end, a middle area, and a tongue end, with each section having a convex upper surface from side-to-side, and a concave lower surface, side-to-side, wherein the front end comprises a thickness in a range from 2 to 5 millimeters, wherein the convex upper surface of the middle area is generally conformable to a vamp of said footwear, and comprises a thickness in a range of 2 to 15 millimeters and a width in a range of 60 to 100 mm, the tongue end comprises a thickness in a range of 2 to 10 millimeters, a width in a range of 10 to 30 millimeters, and extends rearwardly beyond said middle area for a length in a range of 10 to 30 millimeters, wherein an entirety of the removable insert comprises one continuous molded piece with a length in a range from 80 to 120 millimeters, and further, having a means for attaching the removable insert to an interior surface of the footwear.

8. The removable insert as in claim 7, wherein a layer of moisture absorbent material is attached to the concave surface of the middle area of said removable insert.

9. The removable insert as in claim 7, wherein said removable insert is treated with an antibacterial substance.

10. The removable insert as in claim 7, wherein a plurality of ventilating pores extends through the thickness of the middle area of said removable insert.

11. The removable insert as in claim 7, wherein at least one series of perforations is constructed around an outer rim perimeter of the front end of said removable insert.

12. The removable insert as in claim 7, wherein the tongue end comprises an elongated tab with thickness in a range of 2 to 10 millimeters, a width in a range of 20 to 40 millimeters, and extends rearwardly beyond said middle area for a distance in a range of 10 to 20 millimeters.

13. A removable insert for maintaining a shape and condition of various types of footwear, constructed from a semi-rigid, deformable material, comprising three contiguous sections, a front end, a middle area, and a tongue end, with each section having a convex upper surface from side-to-side, and a concave lower surface, side-to-side, wherein the front end comprises a thickness in a range from 2 to 10 millimeters, wherein the convex upper surface of the middle area is generally conformable to a vamp of said footwear, and comprises a thickness in a range of 20 to 30 millimeters and a width in a range of 80 to 120 mm, the tongue end comprises a thickness in a range of 2 to 20 millimeters, a width in a range of 10 to 30 millimeters, and extends rearwardly beyond said middle area for a length in a range of 10 to 30 millimeters, wherein an entirety of the removable insert comprises one continuous molded piece with a length in a range from 100 to 160 millimeters, and further, having a means for attaching the removable insert to an interior surface of the footwear.

14. The removable insert as in claim 13, wherein a layer of moisture absorbent material is attached to the concave surface of the middle area of said removable insert.

15. The removable insert as in claim 13, wherein said removable insert is treated with an anti-bacterial substance.

16. The removable insert as in claim 13, wherein a plurality of ventilating pores extends through the thickness of the middle area of said removable insert.

17. The removable insert as in claim 13, wherein at least one series of perforations is constructed around an outer rim perimeter of the front end of said removable insert.

18. The removable insert as in claim 13, wherein the tongue end comprises an elongated tab with thickness in a range of 2 to 20 millimeters, a width in a range of 20 to 40 millimeters, and extends rearwardly beyond said middle area for a distance in a range of 20 to 40 millimeters.

* * * * *